US005765246A

United States Patent [19]

Shoenhair

[11] Patent Number: 5,765,246

[45] **Date of Patent: *Jun. 16, 1998**

[54] INFLATABLE MATTRESS WITH IMPROVED BORDER SUPPORT WALL

[75] Inventor: John J. Shoenhair, New Hope, Minn.

[73] Assignee: Select Comfort Corporation, Minneapolis, Minn.

[ * ] Notice: The term of this patent shall not extend beyond the expiration date of Pat. No. 5,642,546.

[21] Appl. No.: 782,058

[22] Filed: Jan. 13, 1997

Related U.S. Application Data

[63] Continuation of Ser. No. 538,404, Sep. 19, 1995, Pat. No. 5,642,546.

[51] Int. Cl.[6] ..... A47C 27/08; A47C 27/10

[52] U.S. Cl. ..... 5/680

[58] Field of Search ..... 5/680, 678, 739, 5/740, 724, 736, 710, 713, 901, 400

[56] References Cited

U.S. PATENT DOCUMENTS

| | | | |
|---|---|---|---|
| 4,571,762 | 2/1986 | Rhoton et al. | 5/680 |
| 4,673,452 | 6/1987 | Awdhan | 5/901 |
| 4,799,277 | 1/1989 | Goodale | 5/680 |
| 4,829,616 | 5/1989 | Walker . | |
| 4,890,344 | 1/1990 | Walker . | |
| 4,897,890 | 2/1990 | Walker . | |
| 4,908,895 | 3/1990 | Walker . | |
| 4,991,244 | 2/1991 | Walker | 5/400 |
| 5,077,849 | 1/1992 | Farley | 5/736 |
| 5,136,740 | 8/1992 | Kraft | 5/736 |

*Primary Examiner*—Alexander Grosz
*Attorney, Agent, or Firm*—Patterson & Keough, P.A.

[57] ABSTRACT

A mattress with an inflatable bladder and an outer border wall to support the outer edges of the bladder. The present invention employs foam block border walls that include foam border elements with either an upper or an upper and a lower surface sculpted to present convolutions preferably having generally sinusoidal shapes in vertical cross-section. The convolutions allow for a sensation of softness when being deformed, and allow for ventilation of the inner surface, while at the same time, the foam element can be made of a single piece of foam that is of sufficient stiffness to support the outer perimeter surface of the bladder within the mattress.

19 Claims, 4 Drawing Sheets

INFLATABLE MATTRESS WITH IMPROVED BORDER SUPPORT WALL

This is a Continuation of application Ser. No. 08/538,404 filed Sep. 19, 1995, now U.S. Pat. No. 5,642,546.

FIELD OF THE INVENTION

This invention relates to inflatable body supports, such as air beds. More specifically, it relates to an inflatable mattress having an improved border structure.

BACKGROUND ART

Inflatable mattresses for air beds and water beds are known. U.S. Pat. Nos. 4,908,895 and 4,991,244 to Walker, and assigned to the assignee of the present application, for instance, disclose sophisticated inflatable mattresses suitable for use in high quality air beds.

The '244 patent to Walker discloses an air mattress M (See FIG. 2) that includes a bladder B and a border support wall W that supports and contains the bladder. The border wall provides shape to the mattress, and limits the outward movement of the bladder. Limiting the outward movement of the bladder in turn limits the degree to which the upper surface of the bladder, supported by fluid within the bladder, can be displaced, providing a degree of firmness to the mattress.

Border walls for mattresses are often made of single density foam approximately 4"×6" in cross-section. A drawback associated with this type of mattress construction centers around density and inverse load deflection (ILD) rating specifications of the foam. The foam must be firm enough for the border wall to contain the bladder. Foam that is firm enough to provide containment, however, presents an abrupt change in the softness of the bed, making it uncomfortable to sleep near the side of the bed and providing a feeling of "hard edges" under the legs while sitting on the edge of the mattress.

Additionally, solid foam side walls do not allow for air circulation from within the interior of the mattress. Poor air exchange from within the mattress can cause moisture to become entrapped within the mattress, thereby providing a more favorable environment for the growth and development of fungi, bacteria and other microorganisms. As a result, annoying and unpleasant odors can develop and disease causing pathogens can be harbored.

The '244 Walker patent addresses the above described problems by disclosing a double density foam block wall. Again referring to FIG. 2, the double density block wall W includes a higher density lower layer $W_1$ attached to a lower density upper layer $W_u$ to provide a softer sitting edge at the top of the border, and a bladder containment structure below. Although more comfortable than the single density foam border, the method of manufacture, which requires the joining of the two layers, requires additional steps for joining the layers, and the resultant foam block wall does not allow for air exchange. Accordingly, mattresses with foam borders of double density foam, while imparting greater comfort, tend to be more expensive to manufacture and are susceptible to the moisture accumulation problem discussed above.

SUMMARY OF THE INVENTION

The problems outlined above are in large measure solved by the inflatable mattress with improved border support wall in accordance with the present invention. The mattress hereof includes at least one inflatable bladder, a border support wall for containing the bladder, and a mattress cover. The border support wall includes opposed, head and foot border elements and opposed right and left side border elements that can be detachably joined together to form a border wall having a generally rectangular periphery.

Each border element of the border support wall comprises a foam block that can be enclosed in a fabric case. The foam block is constructed from a single piece of foam having generally planar side surfaces and at least a top surface that includes sculpted convolutions. The foam block lower surface can also include convolutions.

The sculpted convolutions of the foam block upper surface present extended ridges that are interposed between upper surface troughs, with the upperly extending ridges and troughs extending between the side surfaces of the foam block. The sculpted ridges present an inverse load deflection (ILD) characteristic that is less than the ILD characteristic of a solid piece of the same foam. Accordingly, the center portion of the foam block can be firm enough to provide containment support to the mattress bladder, while the top portion of the foam block, with its convolutions, presents a soft to the touch characteristic. Moreover, the trough that extends between the side faces of the foam block allow for ventilation of the interior mattress.

DETAILED DESCRIPTION OF THE DRAWINGS

Figure 1:
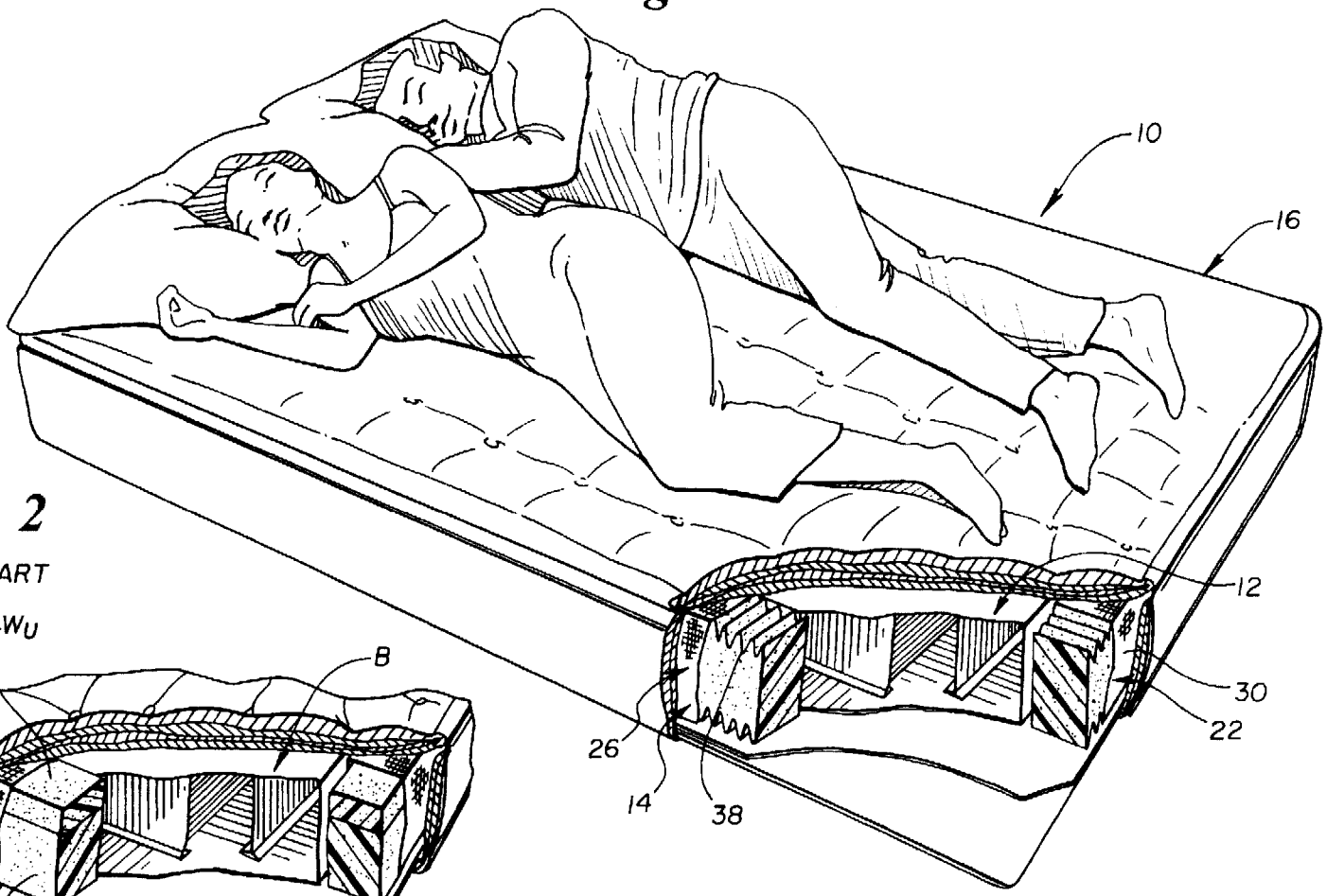
FIG. 1 is a perspective view of an inflatable mattress with improved border support wall in accordance with the present invention, with parts cut away for clarity.
Figure 2:
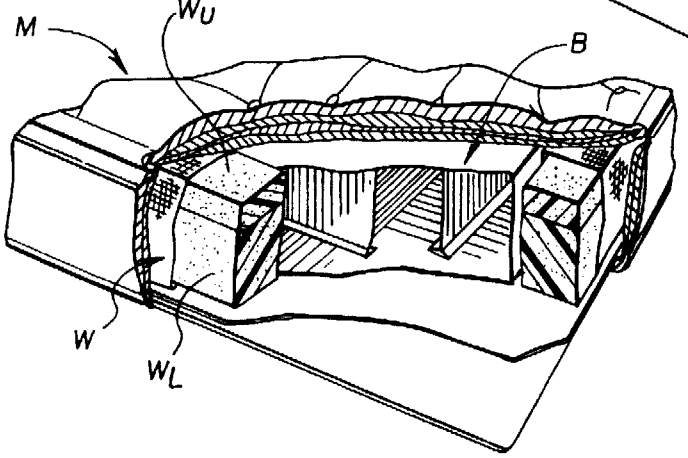
Fig. 2 PRIOR ART
FIG. 2 is a fragmentary, perspective view of a prior art mattress.
Figure 1A:
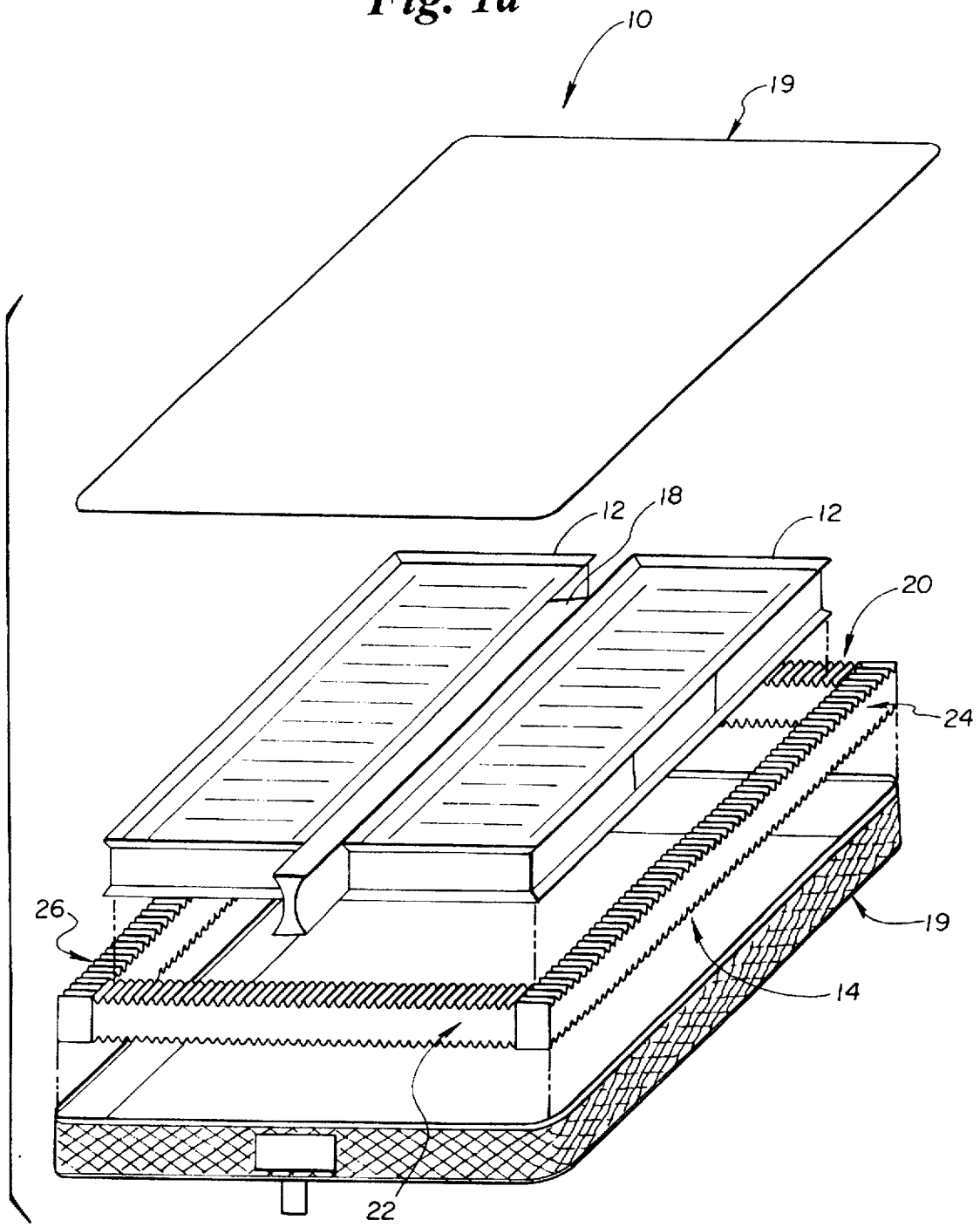
FIG. 1*a* is an exploded perspective view of the mattress depicted in FIG. 1, with parts removed for clarity.

Referring now to the drawings, a mattress 10 in accordance with the present invention broadly includes at least one inflatable bladder 12, border support wall 14, and mattress cover 16. In use, inflatable bladder 12 is inflated or filled with a gas, preferably air. Alternatively, depending on the construction of the bladder 12, it could be filled with water or some other liquid or mixture of liquids. With reference to the exploded depiction of the mattress in FIG. 1*a*, it will be understood that a full size mattress 10 can include two side by side bladders 12, that can be separated by a foam divider 18.

Border support wall 14 includes opposed, head and foot border elements 20, 22 and opposed right and left side border elements 24, 26. With reference to FIGS. 1 and 8–11, each border element 20, 22, 24, 26 can include an internal foam block 28 and a fabric case 30. The case 30 surrounds the foam block 28 in a tight fit and can include a zipper 32 to removably retain the case on the foam block 28. Hook and loop fasteners 34, 36, respectively, can be carried at the ends of each of the border elements for releasably connecting the border elements 20, 22, 24, 26 into the border support wall 14. It should be appreciated that the use of border support wall 14 may be with or without fabric case 30 and still be within the spirit and scope of the present invention.

Foam block 28 is preferably about four inches in depth and about 6 inches in height. The foam block 28 is sufficiently stiff to support and contain inflatable bladder 12. Preferably, foam block 28 is constructed from open or closed cell polyurethane foam with an inverse load deflection (ILD) rating of from about 50 to about 100 pounds, and preferably from about 60 to about 80 pounds, and most preferably about 70 pounds. The ILD rating of the foam will preferably have a higher value than the ILD rating of the inflated bladder 12. Densities for foam block 28 are preferably from 1.0 to 2.0 pounds per cubic foot, with a preferred density of about 1.5 pounds per cubic foot. It will be appreciated that other types of resilient materials, with or without similar ILD values and densities, can be used to make a border wall 14 to accommodate different mattress styles and sizes, varying bladder sizes, different fill mediums (both gases and liquids), and consumer preference as to the preferred firmness.

Each foam block 28 includes opposed upper and lower surfaces 38, 40 and opposed side surfaces 42, 44. The side surfaces 42, 44 each present a generally planar face, but the upper and lower surfaces 38, 40 present sculpted convolutions.

Figure 3:
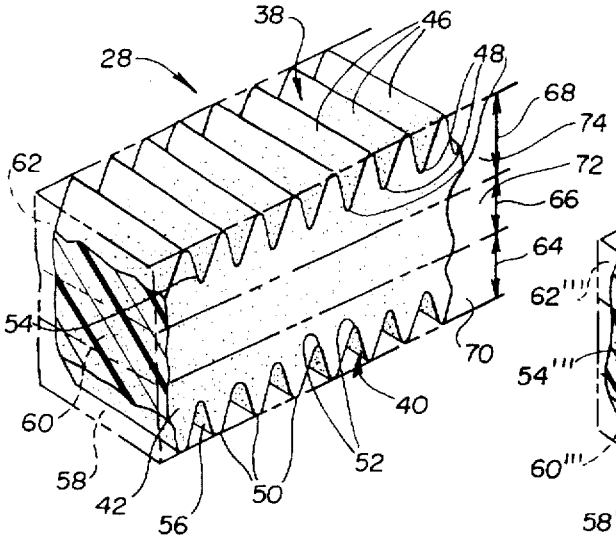
FIG. 3 is a fragmentary, perspective view of the border wall foam block of the present invention.

With reference to FIG. 3, the upper surface 38 includes a plurality of upper surface, upwardly extending ridges 46 interposed between upper surface troughs 48, with the upwardly extending ridges 46 and troughs 48 extending between the side surfaces 42, 44. The lower surface 40 includes a plurality of lower surface, downwardly extending ridges 50 interposed between lower surface troughs 52, with the downwardly extending ridges 50 and lower surface troughs 52 extending between the side surfaces 42, 44. The lower surface troughs 52 are generally aligned with the upper surface upwardly extending ridges 46 such that the peripheral edges 54, 56 of the upper surface 42 and lower surface 44 present the outlines of generally parallel sinusoidal waves.

Referring again to FIG. 3, the foam block 28 can be considered to have three generally equal layers for description purposes; lower layer 58, middle layer 60, and upper layer 62. The maximum vertical dimensions 64, 66, 68 of the layers 58, 60, 62, are generally equal as depicted, and the side surface 42 can be considered to have three generally equal lower, center and upper portions 70, 72, 74 corresponding to the lower, center and upper layers 58, 60, 62, and the lower, middle and upper maximum vertical dimensions 64, 66, 68.

It will be appreciated that the surface area presented by each of the lower and upper portions 70, 74 is less than the surface area presented by the center portion 72 because of the convolutions presented by the upper and lower surfaces 38, 40 of the foam block 28. Similarly, the densities of the lower and upper layers 58, 62 are less than the density of the center layer 60 because of the convolutions.

Referring again to FIG. 1, the uncomfortable hardness that would otherwise be encountered by a person sitting or reclining on the edge of a prior art mattress having a single density foam border is eliminated or reduced by the convoluted upper surfaces 38 of foam blocks 28. The ridges 46 provide initial resistance to a weight placed on the border support wall 14 that is less than the resistance that would be presented by a smooth foam block upper surface. As the ridges 46 on the upper surface 38 of the foam block 28 become compressed due to the downward force, however, more of the foam comes into contact with the object exerting the downward force, resulting in more resistance to the downward force. This initially slight resistance to a downward force that increases as more of foam block upper surface 38 becomes compressed results in a sensation of sitting or reclining upon a soft, but ultimately firm, surface. The lower surface 40 of foam block is also convoluted in the preferred embodiment, providing an enhanced sensation of a softer surface to persons sitting or reclining on the edge of mattress 18.

The troughs 48, 52 presented by the convolutions on the upper and lower surfaces 38, 40 of foam block 28 enable and facilitate air exchange between the other portions of mattress 10. The mattress cover 16 is preferably formed from an air permeable fabric and can include a plurality of perforated discs (not shown) to function as breathing ports. Air exchange between the inner mattress and the atmosphere is facilitated by the contraction or expansion of the inner volume of the mattress 18 as weight is placed on and taken off the mattress 18, the openings provided by the troughs 48, 52 and the mattress cover 19.

Figure 6:
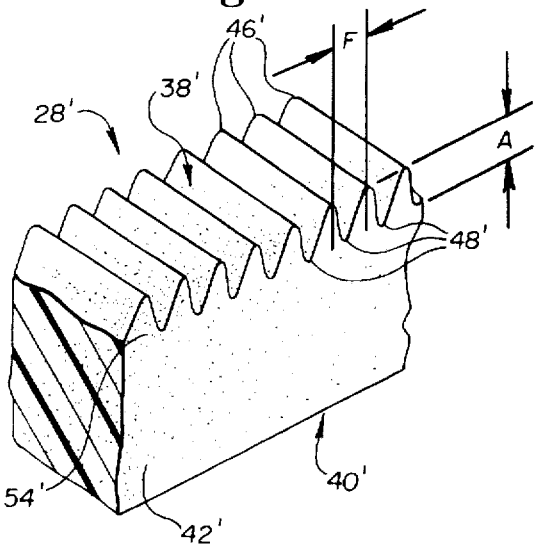
FIG. 6 is a fragmentary, perspective view of a second alternative embodiment of the foam block.

An alternative embodiment of foam block 28' is depicted in FIG. 6. The block 28' is similar in most respects to the block 28 depicted in FIG. 6, and like features are annotated with like numbers. The lower surface 40' of foam block 28', however, is generally planar and does not present lower surface convolutions.

With reference to the annotations of FIG. 6, the softness and capacity to facilitate air exchange of the present invention can be adjusted independently of the properties of the foam used, by adjusting the amplitude A (height) of the convolutions, thereby adjusting the height of the openings defined by the convolutions, and their wavelength F. The amplitude is defined by the vertical distance from the ridge to the trough of a given convolution. The wavelength is defined by the horizontal distance, from ridge to ridge or from trough to trough, between two adjacent convolutions. While annotated in the figures with respect to FIG. 6, it will be understood that the concept of convolution wavelength and amplitude applies to each of the embodiments depicted.

The wavelength to amplitude ratio (F/A) can be used as a measure of the firmness presented by a foam block of the present invention. F/A ratios of about 0.5 to about 2.0 are desirable, with a F/A ratio of about 1.0 being preferred, given a foam with ILD and density characteristics as described above. Dimensions of the wavelength and amplitude of the convolutions of the present invention are between 0.5 inches and 1.5 inches, with 1.0 inches being the preferred dimension.

Figure 4:
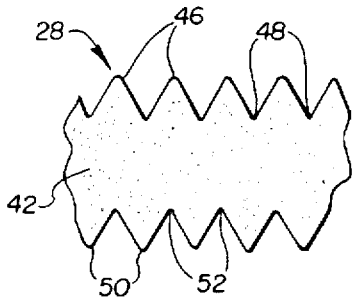
FIG. 4 is a fragmentary, side view of the foam block with the upper and lower convolutions being in phase.
Figure 5:
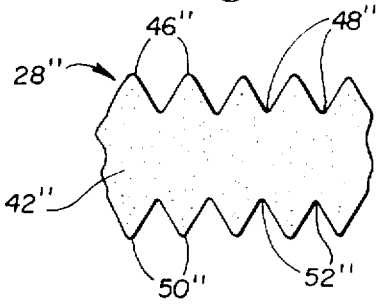
FIG. 5 is a fragmentary, side view of an alternative embodiment of the foam block having upper and lower convolutions out of phase.

FIGS. 4 and 5 are side views that depict a foam block 28 (FIG. 4) with upper and lower convolutions in phase, and a foam block 28" (FIG. 5) having upper and lower convolutions 180° out of phase.

Figure 7:
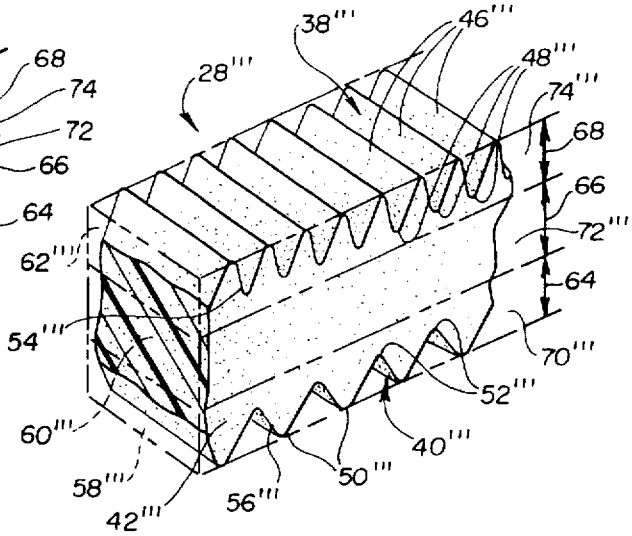
FIG. 7 is a fragmentary, perspective view of a third alternative embodiment of the foam block.
Figure 8:
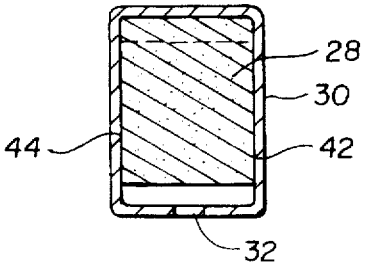
FIG. 8 is a sectional view of a border wall element.
Figure 9:
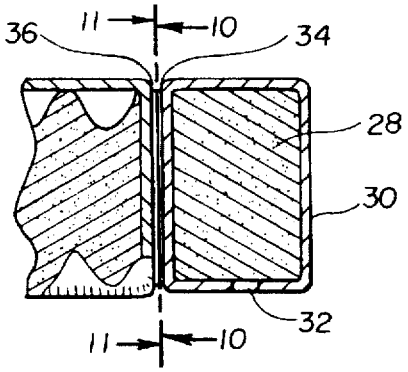
FIG. 9 is a sectional view of two adjacent border wall elements depicting the removable connection of the elements by hook and loop fasteners.
Figure 10:
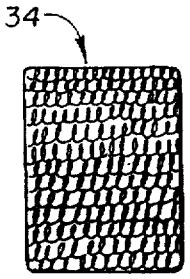
FIG. 10 is a sectional view taken along line 10—10 of FIG. 9.
Figure 11:
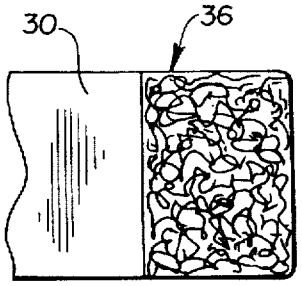
FIG. 11 is a sectional view taken along line 11—11 of FIG. 9.

As will be appreciated, embodiments with more or less dimensional length, depending on foam ILD and density characteristics can also give similar performance, and fall within the scope of this invention. A foam block wall surface comprised of convolutions of varying amplitude and wavelength, such as adjacent convolutions having differing amplitudes or differing wavelengths between different, sequential convolution pairs would also be within the scope of this invention. As another example, with reference to FIG. 7, an alternative embodiment of the foam block 28"' could include upper and lower surfaces 38"', 40"' having different wavelengths. Another embodiment contemplated to be within the present invention is a border wall having altered convolution shapes. Any repeating shape, so long as it reduces the density of the foam material in the upper or lower layer of the border wall, is intended to be within the scope of the present invention as are any shapes which allow for greater ease of compression of the individual convolutions as compared to the solid foam material. It will also be appreciated that irregularly shaped or non-repeating convolutions, which provide the air flow and "cushioning" effect of the "regular" convolutions, are also contemplated to be within the scope of the present invention.

It should be further appreciated that the present invention, while illustrated as a mattress, comprises other fluid-filled body supports, such as cushions, portable mattresses and air or gas filled car and stadium seats.

Foam blocks pursuant to the present invention provide efficiency and economy of construction. More particularly, less foam is required to make multiple pieces of the sculpted design, because the convolutions on the surface of one piece can mirror the convolutions on the surface of another piece. Therefore, if the convolutions are 1 inch high, the same 1 inch of foam material can be used to form the convolutions on the surface of one border element, as is used to form the convolutions on the surface of an adjacent border element cut from the same material.

Still another advantage of the present invention is the easier bending of the mattress containing the present invention when being installed or when used in adjustable beds. Easier bending is also advantageous when the mattress is being transported through hallways and doorways into rooms where there is insufficient room for the mattress to be moved without being bent around doorways or hallway corners.

Yet another advantage is easier packaging of mattresses constructed with the present border walls. Because the foam border walls of the present invention are less stiff than those used in the prior art mattresses, these convoluted foam border walls can be more easily placed into packaging, such as boxes, for shipping.

Specific embodiments of the present invention have been described above. It should be understood, however, that these descriptions are given for illustrative purposes only and that alterations and modifications of the present invention may be practiced without departing from the scope of the present invention. It is, therefore, the intent that the present invention not be limited to the above, but be limited only as defined in the claims appended hereto.

What is claimed is:

1. An improved fluid-filled body support having a bladder for holding a fluid, the improvement comprising:

a border wall made of a foam material, the border wall having an upper surface and lower surface, the upper surface having upper surface convolutions.

2. The improved fluid-filled body support of claim 1 wherein the lower surface of the border wall is substantially planar.

3. The improved fluid-filled body support of claim 1 wherein the lower surface of the border wall has lower surface convolutions.

4. The improved fluid-filled body support of claim 3 wherein the upper and lower surface convolutions are in phase.

5. The improved fluid-filled body support of claim 3 wherein the upper and lower surface convolutions are out of phase.

6. The improved fluid-filled body support of claim 3 wherein the upper surface convolutions have a first wave length and the lower surface convolutions have a second wave length.

7. The improved fluid-filled body support of claim 6 wherein the first and second wave lengths are not equal.

8. The improved fluid-filled body support of claim 6 wherein the first and second wave lengths are equal.

9. The improved fluid-filled body support of claim 1 further including an air permeable fabric cover substantially enclosing the border wall.

10. The improved fluid-filled body support of claim 1 further including the border wall having opposed, spaced-apart, substantially parallel sidewalls.

11. A mattress, comprising:

at least one inflatable bladder having an upper support surface and sidewalls disposed peripheral to the upper support surface; and a border wall being disposed relative to the at least one bladder for supporting the bladder sidewalls, the border wall made of a foam material, the border wall having an upper surface and lower surface, the upper surface having upper surface convolutions.

12. The mattress of claim 11 wherein the lower surface of the border wall is substantially planar.

13. The mattress of claim 11 wherein the lower surface of the border wall has lower surface convolutions.

14. The mattress of claim 11 further including an air permeable fabric cover substantially enclosing the border wall.

15. The mattress of claim 11 wherein the lower surface of the border wall has lower surface convolutions, the upper and lower surface convolutions being in phase.

16. The mattress of claim 11 wherein the lower surface of the border wall has lower surface convolutions, the upper and lower surface convolutions being out of phase.

17. The mattress of claim 11 wherein the lower surface of the border wall has lower surface convolutions, the upper surface convolutions having a first wave length and the lower surface convolutions having a second wave length.

18. The mattress of claim 17 wherein the first and second wave lengths are not equal.

19. The mattress of claim 17 wherein the first and second wave lengths are equal.

* * * * *